US005395212A

United States Patent [19]

Anzai et al.

[11] Patent Number: 5,395,212

[45] Date of Patent: Mar. 7, 1995

[54] MEMBER HAVING INTERNAL COOLING PASSAGE

[75] Inventors: Shunichi Anzai, Hitachi; Kuzuhiko Kawaike, Katsuta; Isao Takehara, Hitachi; Tetsuo Sasada, Hitachi; Hajime Toriya, Hitachi, all of Japan

[73] Assignee: Hitachi, Ltd., Tokyo, Japan

[21] Appl. No.: 255,882

[22] Filed: Jun. 7, 1994

Related U.S. Application Data

[63] Continuation of Ser. No. 907,523, Jul. 2, 1992, abandoned.

[30] Foreign Application Priority Data

Jul. 4, 1991 [JP] Japan ..... 3-164219

[51] Int. Cl.[6] ..... F01D 5/18

[52] U.S. Cl. ..... 416/97 R; 415/115

[58] Field of Search ..... 415/115, 116; 416/96 R, 416/96 A, 97 R

[56] References Cited

U.S. PATENT DOCUMENTS

| | | | |
|---|---|---|---|
| 3,171,631 | 3/1965 | Aspinwall | 416/97 R |
| 3,628,885 | 12/1971 | Sidenstick et al. | 416/97 R |
| 4,416,585 | 11/1983 | Abdel-Messeh | 416/97 R |
| 4,474,532 | 10/1984 | Pazder | 415/115 |
| 4,514,144 | 4/1985 | Lee | 416/97 R |
| 5,052,889 | 10/1991 | Abdel-Messeh | 415/115 |

FOREIGN PATENT DOCUMENTS

| | | | |
|---|---|---|---|
| 2617264 | 10/1977 | Germany | 165/177 |
| 379348 | 3/1940 | Italy | 165/177 |
| 1257041 | 3/1958 | United Kingdom . | |

*Primary Examiner*—Edward K. Look
*Assistant Examiner*—Michael S. Lee
*Attorney, Agent, or Firm*—Antonelli, Terry, Stout & Kraus

[57] ABSTRACT

The present invention effectively cools members with a small amount of cooling air. Turbulence promotor ribs are formed so that cooling fluid along a wall flows from a center of the wall to both end portions of the wall. A highly enhanced thermal conducting effect, namely high cooling heat transfer coefficient, can be obtained, and it is possible to cool members effectively with the small amount of cooling air.

15 Claims, 7 Drawing Sheets

MEMBER HAVING INTERNAL COOLING PASSAGE

This application is a Continuation Application of Ser. No. 07/907,523, filed Jul. 2, 1992, which is now abandoned.

BACKGROUND OF THE INVENTION

1. Field of Industrial Utilization

The present invention relates to improvement of a member having an internal cooling passage, especially, to the improvement of a member having an internal cooling passage with a wall which possesses cooling ribs.

2. Description of the Prior Art

There are various members having an internal cooling passage, but the prior art is explained by a representative gas turbine blade as an example.

A gas turbine is an apparatus for converting high temperature and high pressure gas generated by the combustion of fuel with high pressure air compressed by a compressor as an oxidant to such an energy as electricity by driving a turbine.

Consequently, an increase in the electrical energy, that is obtained by consumption of a unit of fuel, is naturally preferable, and in view of the above described aspect, the improvement of the gas turbine performance is desired. And, as one of the methods for improvement of the gas turbine performed, the elevation of temperature and higher pressurizing of operating gas have been studied. On the other hand, a method for improvement of the total energy conversion efficiency of gas turbines and steam turbines by the elevation of operating gas temperature of the gas turbine and the combining with the steam turbine system utilizing high temperature exhaust gas in forming a combined plant has been proposed.

Operating gas temperature of the gas turbine is restricted by the durable capacity of the turbine blade material against hot corrosion resistance and thermal stress caused by the gas temperature. In elevating the operating gas temperature, a method for cooling the turbine blade by providing hollowed portions, namely a cooling flow passage, in the turbine blade itself, and flowing coolant such as air in the cooling flow passage is conventionally well adopted. More specifically, at least one cooling flow passage is formed inside of the turbine blade, for cooling the turbine blade from inside by flowing cooling air through the cooling flow passage, and, further, the surface, the top end, and the trailing edge of the turbine blade are cooled by releasing cooling air out of the blade through cooling holes provided at the above described cooling portions.

As for the above described cooling air, a part of air bled from a compressor is generally utilized. Accordingly, a large amount of cooling air consumption causes dilution of the gas the temperature and an increase of pressure loss. Therefore, it is important to cool effectively with a small quantity of cooling air.

For realizing a gas turbine having a higher gas operating temperature, it is important to improve heat transfer characteristics inside of the turbine blade for increased cooling effect of supplied cooling air, and various methods for heat transfer enhancement are used.

As one of the methods for heat transfer enhancement, there is a method of providing a plurality of ribs on the walls of cooling passages inside of the turbine blade because it is well known that the heat transfer coefficient can be improved by making an air flow on a thermal conducting plane surface turbulent or by breaking thermal boundary layers etc.

An example of the methods using a structure for heat transfer enhancement is disclosed in the reference, "Effects of Length and Configuration of Transverse Discrete Ribs on Heat Transfer and Friction for Turbulent Flow in a Square Channel", ASME/JSME Thermal Engineering Joint Conference, Vol. 3, pp. 213–218 (1991). The disclosed structure for heat transfer enhancement aims to improve heat transfer coefficient by arranging ribs having a length half of the width of the flow path at both the right and left sides of the flow path, alternately, the ribs extending in a direction perpendicular to the cooling air flow in order to break down the flow boundary layer and to increase turbulency of the cooling air flow with re-attaching flow. The ratio of the ribs pitch and the rib height is preferably about 10.

A second example of the methods using a structure for heat transfer enhancement is disclosed in the reference, "Heat Transfer Enhancement in Channels with Turbulence Promoters", ASME/84-WT/H-72 (1984). The disclosed structure for heat transfer enhancement aims to improve the transfer coefficient by using ribs arranged perpendicularly or slantingly to the cooling air flow in order to obtain the same effect as the above described first example. The slanting angle of the rib to the air flow is preferably from 60° to 70°. And, the ratio of the ribs pitch and the rib height is preferably about 10. An example utilizing the above described structure of the second example and which is further improved in heat transfer coefficient is disclosed in JP-A-60-101202 (1985). The disclosed structure for heat transfer enhancement in this reference is a structure having ribs arranged slantingly to the cooling air flow and additionally having machined slits therein. With the such a rib structure for heat transfer enhancement, it is said that further high cooling performance is realized by the turbulence of air flow behind the slit, and the slit hinders the accumulation of dust around the ribs and, consequently, prevents the lowering of heat transfer coefficient.

As the extracted air sent by a compressor is used for cooling of the turbine blade as previously described, there is an increase of cooling air consumption which lowers the thermal efficiency of the gas turbine. Accordingly, it is important to cool the gas turbine effectively with a small amount of cooling air. But, the above described conventional cooling structure of the turbine blade needs more cooling air in order to meet the elevating of the operation gas temperature of the turbine to a higher temperature, and the improvement of thermal efficiency of the gas turbine is generally small.

SUMMARY OF THE INVENTION

1. Objects of the Invention

The present invention is provided in view of the above described aspect, and the object of the present invention is to provide an enhanced heat transferring rib structure having a further increased heat transfer coefficient, for a gas turbine for example, which rib structure enables the gas turbine blade to be effectively cooled with a small amount of cooling air, and consequently, to realize a high temperature gas turbine having a high thermal efficiency.

2. Methods Solving the Problems

In accordance with the present invention, a member having an internal cooling flow passage possessing a wall furnished with cooling ribs and being cooled by flowing cooling medium in the cooling path, for example a turbine blade, is provided with cooling ribs which are so formed that the cooling medium along the wall flows from the center of the wall to both end portions thereof in order to realize the object of the present invention.

In accordance with forming the above described structure, a large heat transfer coefficient can be obtained because the cooling air flow becomes refracted flow in two directions by the ribs; a three dimensional turbulent eddy is generated; the re-attaching distance of the air flow behind the rib becomes short by the three dimensional turbulent eddy, and vortex generation occurs at the top edge of the rib, etc.

DETAILED DESCRIPTION OF THE EMBODIMENTS

Details of the present invention are explained based on the embodiments referring to drawings.

Figure 1:
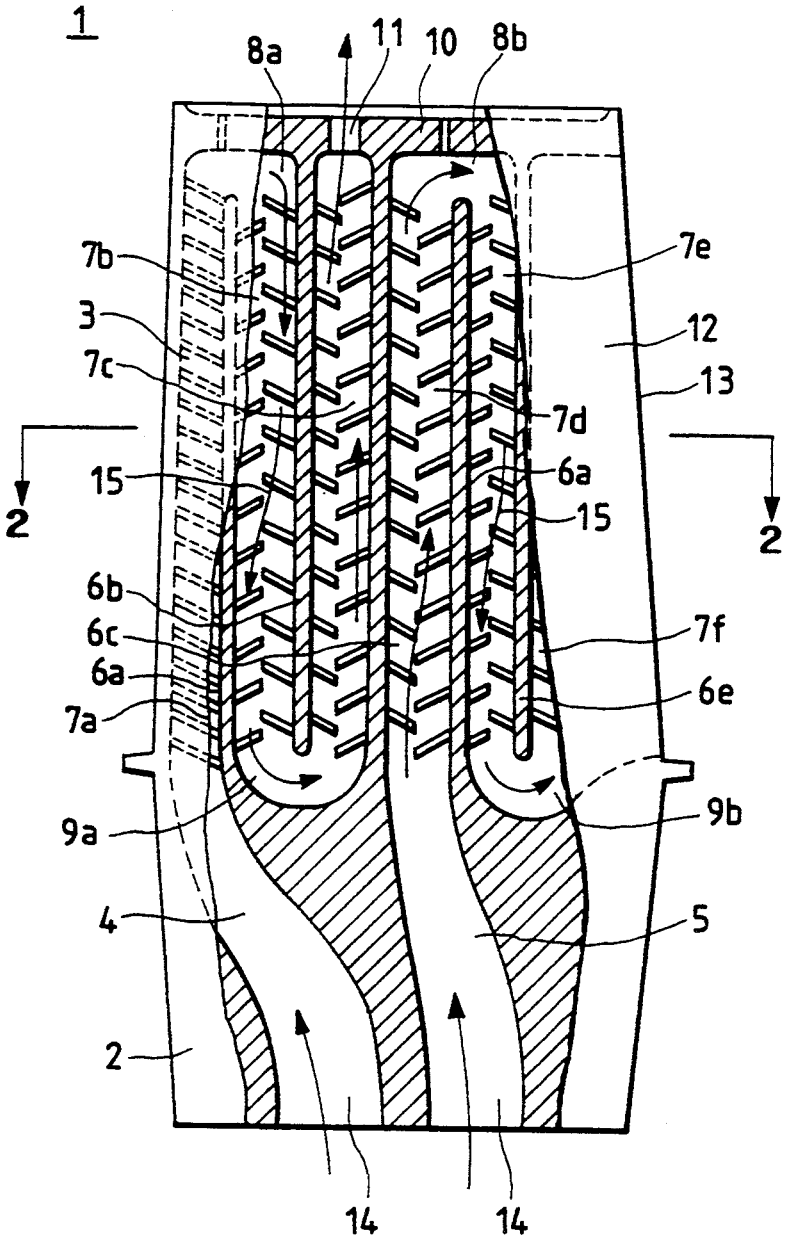
FIG. 1 is a partial vertical cross section of a turbine blade.

FIG. 1 illustrates a vertical cross section of a gas turbine blade (a member) 1 adopting the present invention; element 2 is the shank; element 3 is the blade portion; elements 4 and 5 are a plurality of internal flow passages (cooling medium flow passages) provided from an internal portion of the shank 2 to an internal portion of the blade portion 3.

The internal flow passages 4 and 5 are separated at the blade portion 3 by a plurality of partition walls 6*a*, 6*b*, 6*c*, and 6*d* into a plurality of cooling flow passages 7*a*, 7*b*, 7*c*, and 7*d*, and form serpentine flow passages with top end bending portions, 8*a* and 8*b*, and lower end bending portions, 9*a* and 9*b*. In the present embodiment, the first internal flow passage 4 is composed of the cooling flow passage 7*a*, the top end bending portion 8*a*, the flow passage 7*b*, the lower end bending portion 9*a*, the flow passage 7*c*, and the blowout hole 11 provided at the top end wall of the blade 10. Similarly, the second internal flow passage 5 includes the cooling flow passage 7*d*, the top end bending portion 8*b*, the flow passage 7*e*, the lower end bending portion 9*b*, the flow passage 7*f*, and the blowout portion 13 provided at the blade trailing edge 12.

Cooling air is supplied from a rotor shaft(not shown in the figure), on which the blade 1 is installed, to the air flow inlet 14, and cools the blade from the inside while passing through the internal flow passages 4 and 5. After cooling the blade, the air flow 15 is blown off into the main operating gas through the blowout hole 11 provided at the top end wall of the blade 10 and the blow out portion 13 provided at the blade trailing edge 12.

The ribs for the improvement of heat transfer coefficient according to the present invention are integrally provided on the cooling wall surfaces of the cooling flow passages 7*a*, 7*b*, 7*c*, and 7*d*. The ribs for the improvement of the heat transfer coefficient are formed in a special shape slanting to the flow direction of cooling air in the cooling flow passages.

That is, the ribs for improvement of heat transfer coefficient are so formed that cooling medium flowing along a passage flows from center of the wall of the passage to both end portions of the wall as FIG. 1 illustrates. Further, detail of the structure and the operation is explained hereinafter by referring to FIGS. 2 to 5.

Figure 2:
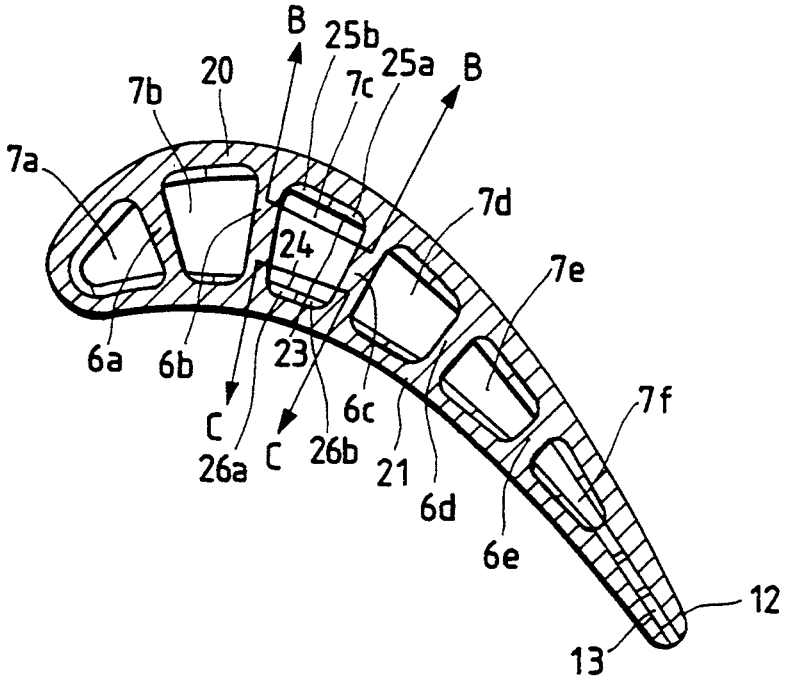
FIG. 2 is a cross section along the A—A line in FIG. 1.

Referring to FIG. 2, the numerals 20 and 21 indicate a blade suction side wall and blade pressure side wall, respectively of blade portion 3 of the turbine blade 1. The cooling flow passages 7*a*, 7*b*, 7*c*, and 7*d* defined by the blade suction side wall 20, the blade pressure side wall 21, and partition walls 6*a*, 6*b*, 6*c*, and 6*d* are also illustrated. For instance, the cooling flow passage 7*c* is composed of the blade suction side wall 20, the blade pressure side wall 21, and partition walls 6*b* and 6*c*. The shape of the above described cooling flow passage differs depending on the design, and the shade could be a trapezoid rhombus or rectangle. The ribs 25*a* and 26*b* for improvement of the heat transfer coefficient, which are formed integrally with the blade suction side wall 20, are provided on the back side cooling plane 23 of the cooling flow passage 7*c*. The ribs 26*a* and 26*b* for the improvement of the heat transfer coefficient, which are formed integrally with the blade pressure side wall 21, are provided on the front side cooling plane 24.

Figure 3:
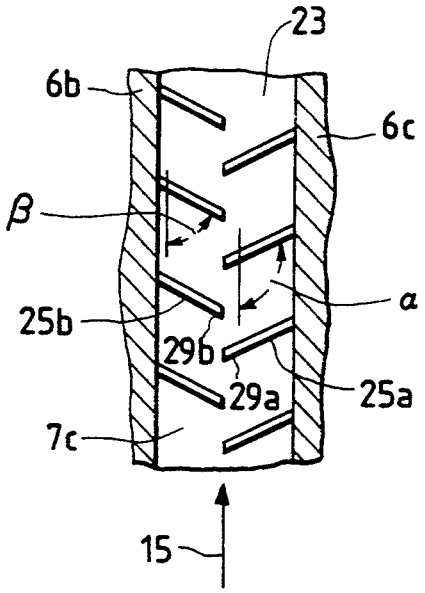
FIG. 3 is a cross section along the B—B line in FIG. 2.
Figure 4:
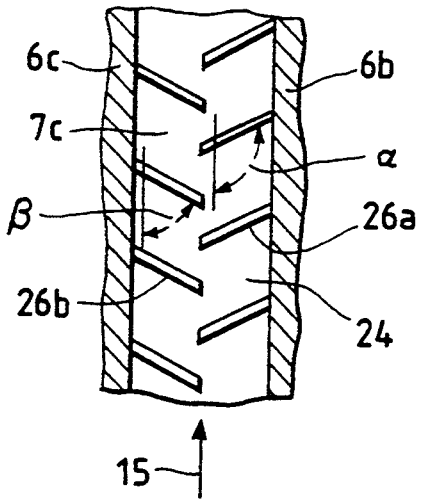
FIG. 4 is a cross section along the C—C line in FIG. 2.

FIG. 3 is a vertical cross section of the cooling flow passage illustrating the B—B cross section in FIG. 2, and the ribs 25*a* and 25*b*, at the back side cooling plane 23 which are arranged respectively, to the right and left from almost the center of the back side cooling plane 23, alternately and with different angles to the cooling air flow direction 15. That is, the rib 25*a* is provided at an angle $\alpha$ in a counterclock direction to the cooling air flow direction and the rib 25*b* is provided at an angle $\beta$, as if the V-shaped staggered ribs are arranged in a manner to place the rib tops or free ends 29*a* and 29*b* at an upstream side of the ribs with respect to the cooling air flow 15. Similarly, FIG. 4 illustrates the C—C cross section in FIG. 2. In FIG. 4, the ribs 26*a* and 26*b* at the front side cooling plane 24 are arranged, respectively on the right and left alternately, from almost the center of the front side cooling plane 24 with different angles to the cooling air flow direction 15. That is, the ribs 26*a* are provided TR an angle $\alpha$ to the cooling air flow direction and the ribs 26*b* are provided at an angle $\beta$, to form the V-shaped staggered ribs structure. The value of the angle $\alpha$ is preferably between 95° and 140°, and value of the $\beta$ is preferably between 40° and 85°.

The cooling flow passage *7c* for the cooling air of ascending flow (in FIG. 1)is illustrated in FIGS. 3 and 4. In case of the cooling flow passage for the cooling air of descending flow, the same V-shaped staggered ribs structure is naturally applied.

Figure 5:
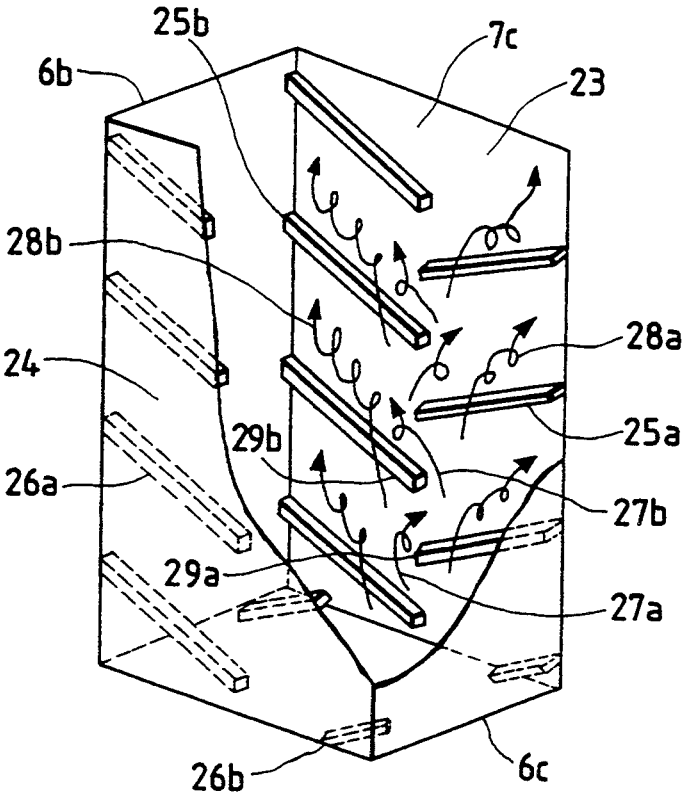
FIG. 5 is a perspective view illustrating cooling passages.

Next, the cooling air flow in the vicinity of the cooling wall depends on the ribs for improvement of the heat transfer coefficient relating to the present invention and is explained by referring to FIG. 5. FIG. 5 is a schematic perspective view of the cooling flow passage *7c*.

The cooling air flow 15 is a saw toothed refractive turbulent flow 27*a* and 27*b* caused by the ribs 25*a* and 25*b* which are slanting to the air flow in a reverse direction to each other at the back side cooling plane 23, and three dimensional rotating turbulent eddies 28*a* and 28*b* are generated behind the ribs. Consequently, an increased cooling side heat transfer coefficient can be obtained. Further, the top end edges (head portions) 29*a* and 29*b* of the ribs 25*a* and 2*b*, respectively are exposed to the cooling air flow, and a much higher cooling heat transfer coefficient can be obtained by synergetic effects. The same effect to improve heat transfer coefficient exists at the front side cooling plane 24, but the explanation of this effect is omitted.

The above described effect of heat transfer enhancement were confirmed by model heat transfer coefficient experiments. The experiments were performed on the first example of the prior art structure, the second example having the slanting ribs structure possessing slits disclosed in JP-A-60-101202 (1985), and the structure relating to the present invention and heat transfer coefficient characteristics of the examples were compared. The shapes of the experimental models and experimental conditions are shown in Table 1.

TABLE 1

| ITEMS | PRIOR ART 1 | PRIOR ART 2 | PRESENT INVENTION |
|---|---|---|---|
| SHAPE OF RIB | | | |
| RIB HEIGHT | 0.7 mm | 0.7 mm | 0.7 mm |
| RIB WIDTH | 0.7 mm | 0.7 mm | 0.7 mm |
| RIB PITCH | 7 mm | 7 mm | 7 mm |
| RIB ANGLE | 90° | 110° | $\alpha$ 110° $\beta$ 70° |
| SLIT WIDTH | — | 0.5 mm | — |
| PATH WIDTH | 10 mm | 10 mm | 10 mm |
| PATH HEIGHT | 10 mm | 10 mm | 10 mm |
| EXPERIMENTAL CONDITION | | | |
| MEDIUM | AIR | AIR | AIR |
| EXPERIMENTAL RANGE, Re | $1.5 \times 10^4 \sim 1.5 \times 10^5$ | $1.5 \times 10^4 \sim 1.5 \times 10^5$ | $1.5 \times 10^4 \sim 1.5 \times 10^5$ |

Re: Reynolds number

The experimental model formed a rectangular flow passage which was 10 mm wide and 10 mm high, and a pair of facing planes were used as heat transferring planes having the ribs for improvement of heat transfer coefficient; and another pair of facing planes were used as insulating layers. As Table 1 reveals, each of the ribs for improvement for heat transfer coefficient is almost equivalent to the others in its shape (because rib height, rib width, and rib pitch (pitch/rib height=10) are all same). The experiment was performed in such a manner that the heat transferring plane side was heated; and low temperature air was supplied into the cooling flow passage.

Figure 6:
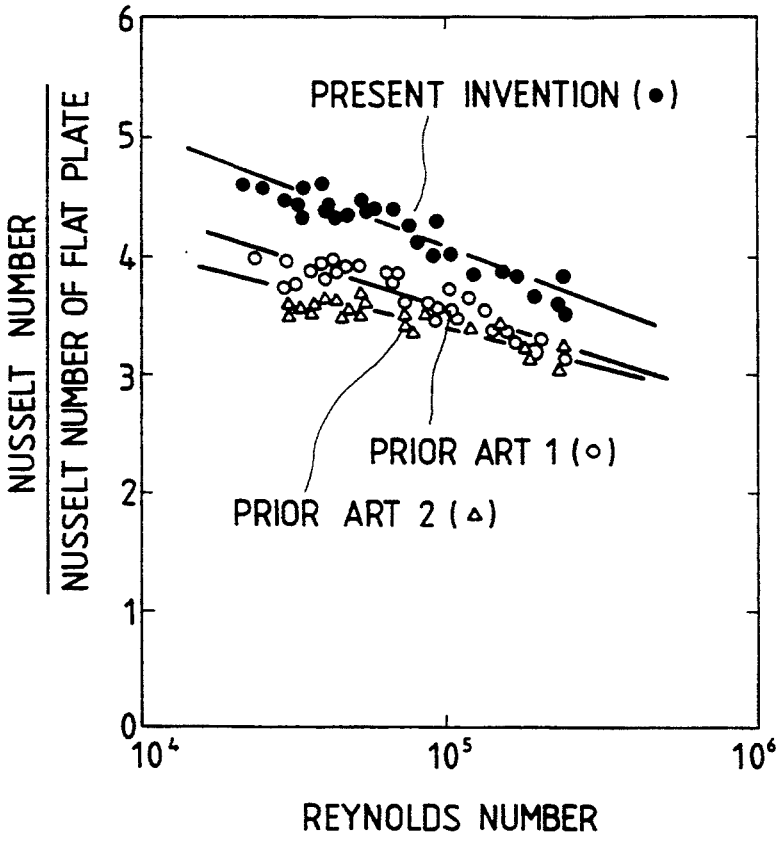
FIG. 6 is a graph illustrating experimental results on thermal conducting characteristics.

The results of the experiments on heat transfer coefficient characteristics are shown in FIG. 6 and compared on the graph in FIG. 6. Referring to FIG. 6, the comparison was performed with the abscissa indicating the Reynolds numbers which express flow condition of the cooling air and the ordinate indicating a ratio of an average Nusselt number which expresses the flow condition of heat and an average Nusselt number of a flat heat transfer surface without ribs for improvement of the heat transfer coefficient. In FIG. 6, the larger the value on the ordinate, with a constant Reynolds number (same cooling condition) the more preferable the cooling performance is. As FIG. 6 reveals, the thermal conducting performance of the structure relating to the present invention is clearly preferable in comparison with the conventional structures. Under the condition of Reynolds number $5\times10^5$, which is close to the cooling air supply condition in rated gas turbine operation, the structure relating to the present invention has the higher heat transfer coefficient by about 18% in comparison with the prior art 1, and by about 20% in comparison with the prior art 2. That reveals a structure of the present invention with superior performance.

Figure 7:
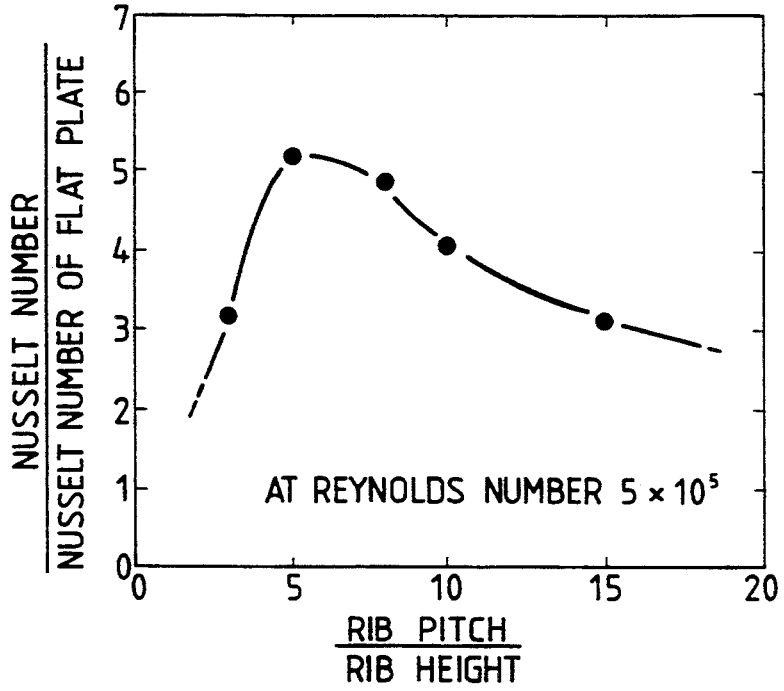
FIG. 7 is a graph illustrating experimental results on thermal conducting characteristics.

In the model heat transfer coefficient experiment, the effect of the ratio of the pitch and the height of the ribs for the improvement in heat transfer coefficient with the structure relating to the present invention on heat transferring performance was confirmed. In FIG. 7, the effect of the improvement in heat transfer coefficient is shown with the abscissa which indicates the ratio of the pitch and the height of the ribs for the improvement of heat transfer coefficient. The case shown in FIG. 7 is with the cooling condition of Reynolds number $5\times10^5$. As FIG. 7 reveals, the remarkable effect for the improvement of the heat transfer coefficient is realized in a range of the ratio of the pitch and the height of the ribs between 4 and 15. The improving effect of heat transfer coefficient of the above described conventional structure is said to be remarkable when the ratio of the pitch and the height of the ribs for improvement of heat transfer coefficient is about 10, but the structure relating to the present invention realizes the remarkable improving effect of heat transfer coefficient in a wider range of the ratio. The reasons for this are that the cooling air flow becomes the saw toothed refractive turbulent flow by the ribs and further, the three dimensional rotating turbulent eddies are generated behind the ribs, and the high cooling heat conductance is obtained by exposing the top end edges of the ribs to the cooling air flow. Especially, the three dimensional rotating turbulent eddies behind the ribs shorten the reattaching distance of the cooling air behind the ribs by the rotating power of the eddies, and a more preferable effect than the prior art is obtained.

The above description explains a fundamental structure of the present invention, but, further, various embodiments, modifications, and applications are available.

Other examples of the structure of the ribs for improvement of heat transfer coefficient being applied in the present invention are illustrated in FIGS. 8–11 all of which are shown as B—B cross sections of the cooling flow passage 7c as described in FIG. 3.

Figure 8:
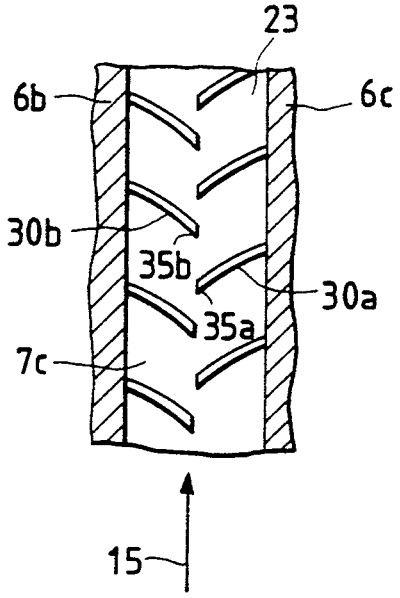
FIG. 8 is a cross section around a cooling flow passage.

The structures of the ribs 30a and 30b for the improvement of heat transfer coefficients, illustrated in FIG. 8 are curved structures in a circular arc shape; the heads 35a and 35b of which, are oriented to an upstream side of the cooling air flow 15, and the ribs are respectively staggeringly arranged on the right and the left alternately with respect to the cooling air flow direction.

Figure 9:
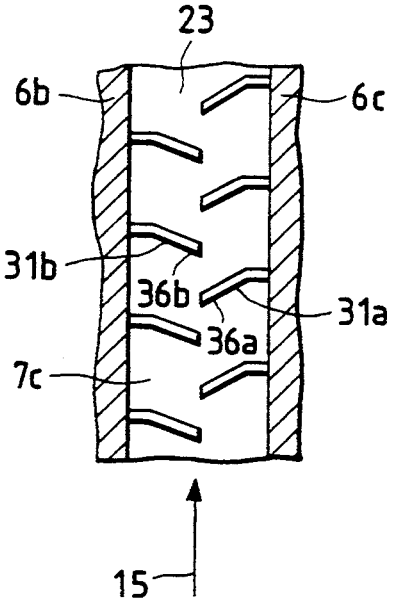
FIG. 9 is a cross section around a cooling flow passage.

The structures of the ribs 31a and 31b for improvement of heat transfer coefficients, illustrated in FIG. 9 are the same as the ribs in the above described first embodiment except that upper base ends of the ribs at the partition plates, 6b and 6c, are perpendicularly arranged to the cooling air flow direction; the outer ends or heads 36a and 36b of the ribs are oriented to the upstream side of the cooling air flow 15, and the ribs are staggeringly arranged on the right and the left alternately in the cooling air flow direction.

Figure 10:
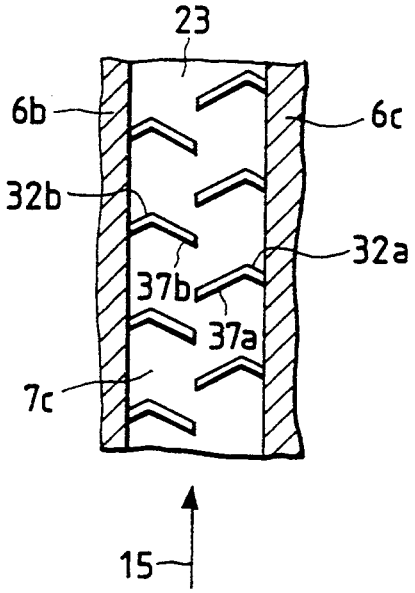
FIG. 10 is a cross section around a cooling flow passage.
Figure 11:
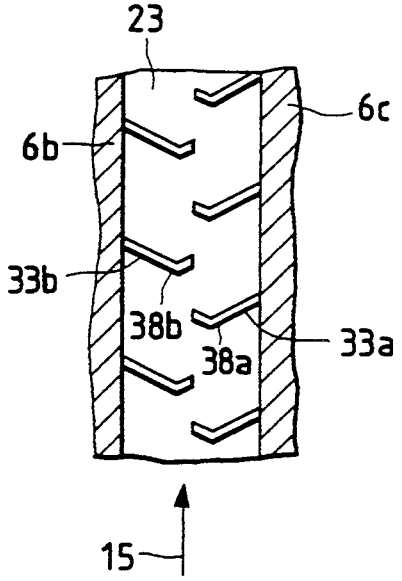
FIG. 11 is a cross section around a cooling flow passage.

The ribs 32a and 32b illustrated in FIG. 10 are a staggered arrangement of chevron shaped ribs, of which lower free end portions 37a and 37b are oriented to the upstream side of the cooling air flow direction, and, further. The ribs 33a and 33b illustrated in FIG. 11 are a staggered arrangement of inverted chevron shape ribs, of which head portions 38a and 38b are oriented to the upstream side of the cooling air flow direction. In any of above described additional embodiments, a large cooling heat transfer coefficient is obtained the same as in the previously described first embodiment and is obtainable without changing the aim of the present invention by making saw-toothed refractive turbulent cooling air flow, generating the three dimensional rotating turbulent eddies behind the ribs, and exposing the top end edges of the ribs to the cooling air flow.

In other words, various shapes such as a straight line type, a curved line type, and a chevron type etc. are usable for the ribs relating to the present invention, but substantially at least the ribs are staggeringly arranged on the right and left alternately in the cooling air flow direction on the cooling planes in the cooling flow passage so that the head portions of the ribs at the central side of each of the cooling planes are oriented to the upstream side of the cooling air flow.

Figure 12:
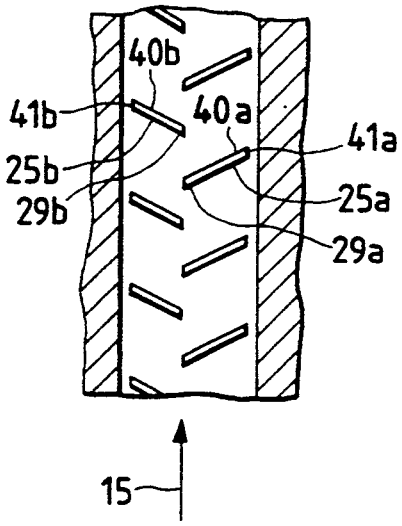
FIG. 12 is a cross section around a cooling flow passage.

The modified examples of the present invention are explained by taking the modification of the previously described first embodiment as examples referring to FIGS. 12–15. Referring to FIG. 12, a structure is illustrated in which gaps, 41a and 41b, are provided between the upper ends, 40a and 40b, of the ribs 25a and 25b at the partition plate, 6a and 6b, side and the partition plates, 6a and 6o. The intensity of turbulence behind the ribs is increased by the cooling air flow flowing through the gaps, 41a and 41b, and accordingly, thermal conducting performance is improved and the lowering of thermal conducting performance can be prevented by an effect hindering the stacking of dust.

Figure 14:
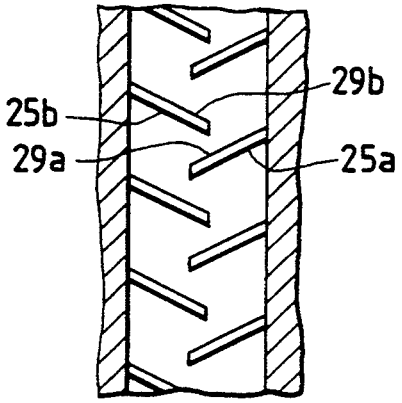
FIG. 14 is a cross section around a cooling flow passage.
Figure 13:
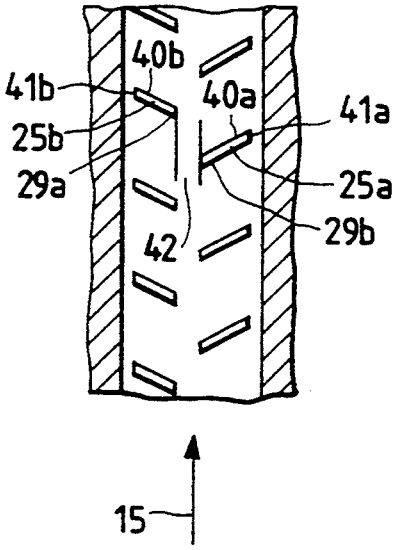
FIG. 13 is a cross section around a cooling flow passage.
Figure 15:
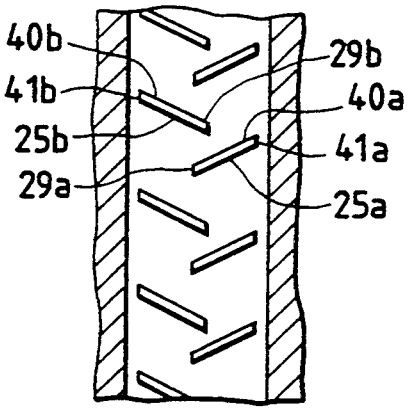
FIG. 15 is a cross section around a cooling flow passage.

Referring to FIG. 13, a structure is illustrated in which a gap 42 is provided between head portions, 29a and 29b, of the ribs 25a and 25b for improvement for heat transfer coefficient at a central portion of the cooling air path. Referring to FIG. 14, a structure is illustrated in which the head portions, 29a and 29b, of the ribs 25a and 25b, at a the central portion of the cooling air path overlap each other. Further, a structure in which the gaps, 41a and 41b, are provided between upper end portions, 40a and 40b, of the ribs 25a and 25b, and the partition plates 6a and 6b, is illustrated in FIG. 15. In any of the modified examples, the V-shaped staggered ribs arrangement is a base, and the more improved effect of the thermal conducting performance than the previously described embodiments aid the hindering effect of dust stacking are realized without losing the aforementioned advantage of the present invention. The modified examples illustrated in FIGS. 12–15 are all based on the previously described first embodiment. The same modifications of the other embodiments illustrated in FIGS. 8–11 are possible.

The partition walls 6a, 6b, and 6c of the above described gas turbine blade 1 operate as cooling heat removal planes in addition to forming the cooling air flow path. In a case of the gas turbine using the operating gas of a much higher temperature, the positive utilization of the partition walls for cooling is preferable.

Figure 16:
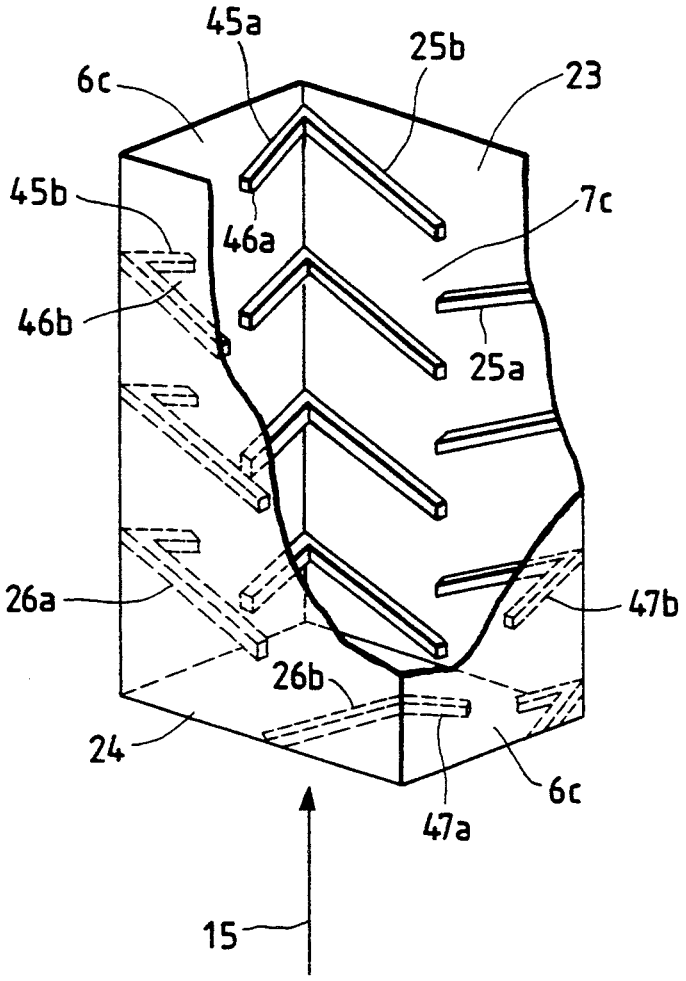
FIG. 16 is a perspective view illustrating cooling flow passages.

An example of an application of the present invention to positive cooling utilizing the partition walls is illustrated in FIG. 16. The example is illustrated in FIG. 16 as a perspective view in comparison with the previous first embodiment which is illustrated in FIG. 5 as the perspective view. In FIG. 16, the same members as those in FIG. 5 are indicated with the same numerals as those in FIG. 5, and elements 45a and 45b are V-shaped staggered ribs for the improvement of the heat transfer coefficient formed integrally with the partition wall 6b, on the partition wall 6b which forms the cooling flow passage 7c, and the ribs are so provided that the head portions, 46a and 46b, of the ribs are oriented to the upstream side of the cooling air flow 15. Similarly, the partition wall 6c is provided with the ribs for the improvement of heat transfer coefficients, 47a and 47b. In accordance with the above described structure, a turbine blade for a high temperature gas turbine using an operating gas of higher temperature can be provided. Further, as for the shapes of the ribs, 45a, 45b, 47a, and 47b, for the improvement of heat transfer coefficient, other structures illustrated in FIGS. 8–11 can be naturally used.

The uniform temperature distribution in a gas turbine blade is preferable in view of the strength of the blade. On the other hand, the external thermal condition of the turbine blade differs depending on locations around the blade. Accordingly, in order to cool the blade to a uniform temperature distribution, rib structures for the improvement of heat transfer coefficient at the suction side of the blade, the pressure side of the blade, and the partition wall are preferably designed to be matched structures to the external thermal condition. That is, concretely saying, the structure, the shape, and the arrangement of the ribs for the improvement of the heat transfer coefficient are selected from the ribs illustrated in the above described embodiments or modified examples so as to match the requirement of each cooling plane.

The gas turbine has been hitherto taken as an example in the explanation, but the present invention is naturally applicable not only to the gas turbine but also to any members having internal cooling flow passages as previously described. In the above described explanation, a return flow structure having two internal cooling flow passages is taken as an example, but the example does not give any restriction to number of cooling flow passages in application of the present invention. Further, although the rectangular cross sectional shape of the cooling flow passages is taken as an example in explanation of the above embodiments, the shape of the cooling flow passage can be trapezoidal, rhomboidal, circular, oval, and semi-oval etc. And, the explanation is performed with taking air as a cooling medium, but other medium such as steam etc. are naturally usable. The gas turbine blade adopting the structure relating to the present invention has a simple construction and, accordingly, the blade can be manufactured by current precision casting.

What is claimed is;

1. A turbine blade having internal cooling fluid flow passages through which cooling fluid can flow for cooling said turbine blade, said cooling fluid flow passages including blade suction side and blade pressure side walls each having turbulence promotor ribs, wherein said turbulence promotor ribs of each of said side walls consist of first ribs each arranged to extend obliquely to a flow direction of cooling fluid in its associated passage and downstream with respect to the flow direction of cooling fluid from a central portion between said end portions of the associated side wall to one of the side end portions of the associated side wall and second ribs each arranged to extend obliquely to the flow direction of cooling fluid and downstream with respect to the flow direction of cooling fluid from the central portion of the associated side wall to the other side end portion of the associated side wall, and wherein said first ribs and said second ribs are staggerly arranged with respect to each other on the associated side wall in the flow direction of the cooling fluid so that the cooling fluid along the associated side wall flows from the central portion of the associated side wall toward the side end portions thereof.

2. A turbine blade having internal cooling fluid flow passages as claimed in claim 1, wherein said first ribs and said second ribs are inclined at a range from 40 degrees to 85 degrees with respect to the flow direction of the cooling fluid.

3. A turbine blade having internal cooling fluid flow passages as claimed in claim 2, wherein said first ribs and second ribs are formed in a curved shape which is concave shape with respect to the flow direction of the cooling fluid.

4. A turbine blade having internal cooling fluid flow passages as claimed in claim 2, wherein said first ribs and said second ribs are formed in a zigzag shape which is concave with respect to the flow direction of the cooling fluid.

5. A turbine blade having internal cooling fluid flow passages as claimed in claim 1, wherein end portions of said first ribs and said second ribs at said central portion of the wall are overlapped with respect to the flow direction of the cooling fluid flow.

6. A member having internal cooling fluid flow passages as claimed in claim 5, wherein said first ribs and said second ribs are formed in curved shape having or a zigzag shape a concave shape or a zigzag shape with respect to the flow direction of the cooling fluid.

7. A turbine blade having internal cooling fluid flow passages as claimed in claim 5, wherein said first ribs and said second ribs are formed in a zigzag shape which is concave with respect to the flow direction of the cooling fluid.

8. A turbine blade having internal cooling fluid flow passages through which cooling fluid can flow for cooling said passages turbine blade, at least one of said cooling fluid flow passages including a rectangular cross section part defined by facing walls spaced form each other and partition walls, said facing walls each defining an inside and an outside of said turbine blade, extending in a flow direction perpendicular to a rectangular cross section part and having side end portions at said partition walls in a direction perpendicular to said flow direction, each of said facing walls having turbulence promotor ribs, wherein said turbulence promotor ribs on each of said facing walls comprise first and second rib rows arranged in said flow direction, each rib of said first rib row extending obliquely to said flow direction from a central portion between said side end portions of said associated facing wall to one of said side end portions of said associated facing wall so as to be remote from said central portion toward a downstream side, and each rib of said second rib row extending obliquely to said flow direction from a central portion between said side end portions of said associated facing wall to the other side end portion of said associated facing wall so as to be remote from said central portion toward a downstream side, and wherein ribs of said first rib row and ribs of said second rib row on each of said facing walls are staggerly arranged with respect to each other on their associated facing wall in the flow direction of the cooling fluid.

9. A turbine blade having internal cooling fluid flow passages as claimed in claim 8, wherein gaps are provided between wall side end portions of said first ribs and said second ribs and walls adjacent to the facing walls being formed with said turbulence ribs.

10. A member having internal cooling fluid flow passages as claimed in claim 8 or claim 9, wherein an additional gap is provided between said first rib row and said second rib row.

11. A turbine blade having an internal cooling fluid flow passage having a rectangular cross section and facing walls each having turbulence promotor ribs, said facing walls being a blade suction side wall and a blade pressure side wall each of which defines an outside and an inside of said blade, wherein said turbulence promotor ribs of each of said side walls consist of a plurality of first ribs each arranged to extend obliquely to a flow direction of cooling fluid in its associated passage and downstream with respect to the flow direction of cooling fluid from a center of its associated side wall of the facing walls to an end portion of the associated side wall so as to be remote in a downstream direction and a plurality of second ribs each arranged to extend obliquely to a flow direction of cooling fluid in said associated passage and downstream with respect to the flow direction of cooling fluid from the center of the associated side wall to another end portion of said associated side wall so that a cooling fluid along the wall flows form the center of the associated side wall to end portions thereof, and wherein said first ribs and said second ribs are staggerly arranged with respect to each other on said associated side wall in said flow direction of the cooling fluid.

12. A turbine blade having internal cooling fluid flow passages as claimed in claim 11, wherein said first ribs and said second ribs are arranged so that a ratio of rib pitch to a rib height of each of said first ribs and said second ribs is between 4 and 15.

13. A turbine blade comprising internal cooling fluid flow passages through which cooling fluid can flow for cooling said turbine blade, wherein at least one of the cooling fluid flow passages includes two side walls which are a blade suction side wall and a blade pressure side wall, respectively, each side wall defining an outside and an inside of said turbine blade and having thereon a plurality of ribs arranged in first and second rows in a flow direction of cooling fluid flow therein;

wherein each rib of said first row extends obliquely to the flow direction from a central portion between side end portions of its associated side wall toward one of said side end portions so as to be remote from said central portion of its associated side wall in the direction of the flow of the cooling fluid flow, and each rib or said second row extends obliquely to the flow direction from a central portion between side end portions of its associated side wall formed with said ribs toward the other side end portion thereof so as to be remote from said central portion of its associated side wall in the direction of the flow of the cooling fluid flow; and wherein each rib of said first row and each rib of said second row on each of said two side walls are staggerly arranged with respect to each other on their associated side wall in the flow direction.

14. A turbine blade as claimed in claim 13, wherein said at least one cooling fluid flow passage further includes a pair of partition walls at said side end portions of said blade suction side and blade pressure side walls for defining said passage with a substantially rectangular cross section, said ribs extend partially on said partition walls beyond said side end portions of said blade suction side and blade pressure side walls.

15. A turbine blade as claimed in claim 13, wherein one end of each rib of said first and second rib rows at said central portion between said side end portions are aligned to a center line between said side end portions of each of said blade suction side and blade pressure side walls.

* * * * *